United States Patent [19]

Oide

[11] 4,401,442

[45] Aug. 30, 1983

[54] HIGH-SPEED DISK GRINDSTONE AND PROCESS FOR PRODUCING THE SAME

[75] Inventor: Kunimasa Oide, Kawanishi, Japan

[73] Assignee: Daichiku Co., Ltd., Hyogo, Japan

[21] Appl. No.: 251,980

[22] Filed: Apr. 6, 1981

Related U.S. Application Data

[63] Continuation of Ser. No. 83,397, Oct. 10, 1979, abandoned.

[30] Foreign Application Priority Data

Oct. 18, 1978 [JP] Japan ..... 53-128870
Oct. 21, 1978 [JP] Japan ..... 53-129838

[51] Int. Cl.[3] ..... B24D 3/28

[52] U.S. Cl. ..... 51/297; 51/307; 51/308

[58] Field of Search ..... 51/295, 297, 307, 308

[56] References Cited

U.S. PATENT DOCUMENTS

| | | | |
|---|---|---|---|
| 1,655,371 | 1/1928 | Keay | 51/297 |
| 2,378,386 | 6/1945 | Baumgartner | 51/297 |
| 2,457,012 | 12/1948 | Upper | 51/297 |
| 2,457,516 | 12/1948 | Allison | 51/297 |
| 3,030,743 | 4/1962 | Raymond | 51/207 |
| 3,540,869 | 11/1970 | Bauer | 51/298 |
| 3,631,638 | 1/1972 | Yoshikawa et al. | 51/297 |
| 3,840,357 | 10/1974 | Shimizu | 51/297 |
| 3,918,218 | 11/1975 | Zoiss | 51/298 |
| 3,950,148 | 4/1976 | Fukuda | 51/297 |
| 4,230,461 | 10/1980 | Sandman et al. | 51/297 |

*Primary Examiner*—James H. Derrington
*Attorney, Agent, or Firm*—Koda and Androlia

[57] ABSTRACT

A process for producing a highly porous and extremely hard resinoid rotating disk grindstone that withstands rapid rotation comprising the steps of forming uncalcined unit grindstones by inserting 1–3 glass mesh cloths into a layer of polishing powder every 2–10 mm in the grindstone; press molding this reinforced composition; and these unit grindstones being laminated and united by calcination. The grindstone obtained using this process is highly porous compared to ordinary composite grindstones. Its bulk specific gravity is 2.2 or below and the degree of bonding indicates great hardness (0.25 or below). Also, its grinding capacity proved to be about 2–3 times that of grindstones formed using the same materials, and about 1.3–1.8 times that of commercial high-performance products.

2 Claims, 4 Drawing Figures

HIGH-SPEED DISK GRINDSTONE AND PROCESS FOR PRODUCING THE SAME

This is a continuation of application Ser. No. 083,397, filed Oct. 10, 1979, now abandoned.

BACKGROUND OF THE INVENTION

1. Field of the Invention

This invention relates to a high-speed resinoid disk rotating grindstone and a process for producing the same.

2. Prior Art

As has been suggested by the inventors, the laminated rotating grindstone (where 0.05–1 mm spaces are created between adjacent disk grindstones) shows markedly improved grinding efficiency over commercial thick grindstones without these spaces. Moreover, it is a superior grindstone with little grindstone burn. In fact, it is being merchandized and supplied for use. The reasons that the grinding efficiency of the laminated rotating grindstone is superior are believed to be as follows. The gaps between the laminated grindstones act to generate air currents. Powder is thereby removed during grinding, so grindstone surface pore shrinkage is eliminated. Meanwhile, this air current generation air cools the grinding surface and enlarges the heat radiation area, so there is no burn damage to edges and ground material due to regeneration. Consequently, the grindstone surface is always kept new and sharp. Furthermore, the entire ground surface is not ground by the grindstone surface, and portions remain in stripes. These portions are ground by means of the destructive action due to grindstone sideslipping, so an increased grinding efficiency results.

However, the laminated rotating grindstone has several defects along with the aforementioned superior sharpness. In particular, grinding stripes remain in the surface of the ground material when the grinding material is always in a fixed position (e.g., plunge cut). Here, the destructive action due to sideslipping cannot be utilized, so the remaining grinding stripes appear as defects. Additionally, this grindstone is defective in that the production cost is high because it is produced using an operation where the adjacent grindstones are individually formed and calcined (or calcinated), after which they are laminated leaving fixed spaces.

SUMMARY OF THE INVENTION

Accordingly, it is the primary object of this invention to provide a high-speed resinoid disk rotatable grindstone which is free from those defects mentioned above.

In keeping with the principles of this invention, the objects are accomplished by adjusting two rather conflicting properties, i.e. the high porosity and the high strength. More specifically, the high-speed resinoid disk rotating grindstone of this invention comprises a number of unit grindstones laminated and calcined into any integral piece, said unit grindstones having 1–3 glass fiber mesh cloths inserted every 2–10 mm thickness of grinding granule.

DETAILED DESCRIPTION OF THE INVENTION

The production process of such a new high-speed rotating grindstone will be explained in detail while comparing it to the conventional rotating grindstone in FIG. 3.

Figure 1:
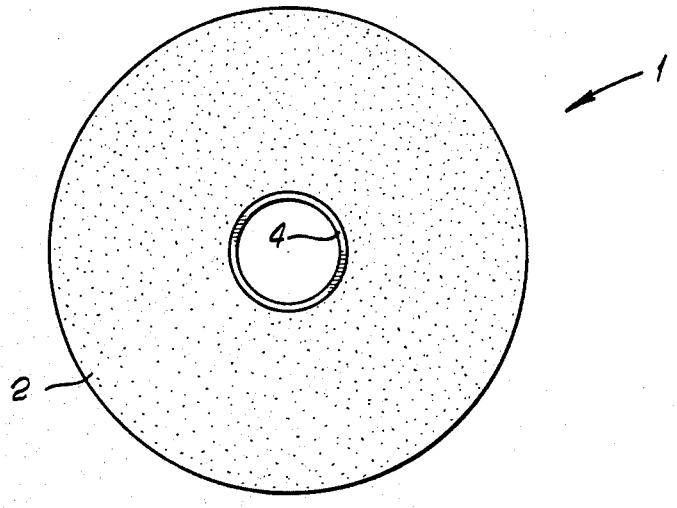
FIG. 1 shows a top plan of an embodiment of a high-speed grindstone of this invention.
Figure 2:
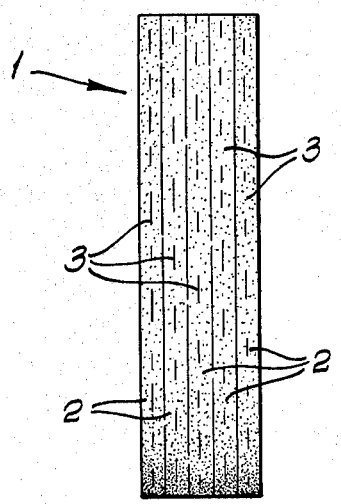
FIG. 2 shows a side view of the grindstone in FIG. 1.
Figure 4:
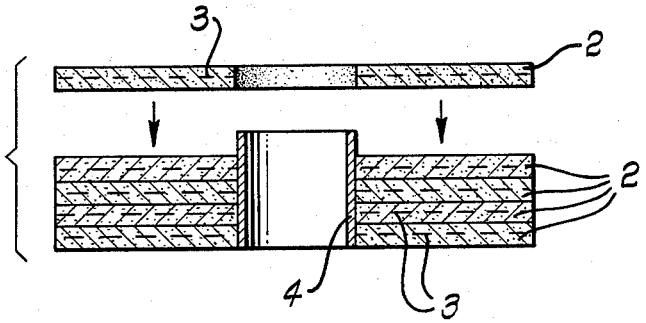
FIG. 4 shows a section view of the grindstone in FIG. 1.

As is clear in FIG. 2, the high-speed rotating grindstone of this invention features a laminated structure. Its structure will now be explained in further detail along with the production process. As is seen in FIG. 4, unit grindstones (2) (thin grindstones about 2–10 mm thick) are first press-formed. These unit grindstones (2) are formed using polishing powder and thermosetting resin after inserting 1–3 glass fiber mesh cloths into the units for reinforcement. Next, the laminated high-speed rotating grindstone (2) is completed by laminating these unit grindstones (2) to a fixed thickness along the axial pipe (4) and calcinating (180°–200° C., about 24 hours).

Figure 3:
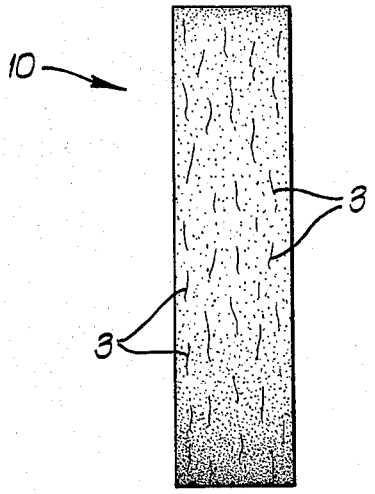
FIG. 3 shows a side view of a conventional high-speed rotating grindstone.

FIG. 3 is a side view of a conventional rotating grindstone (10). As is seen in the figure, there are many glass fibers on its outer circumference (i.e. the grinding surface), and they are arranged unevenly (i.e. randomly in oblique and vertical directions). Moreover, the length of the glass fibers (3) on the grinding surface is great. This uneveness resulted because (a) a laminated structure like the one in this invention was not used, and (b) spacing of the glass fiber mesh cloths could not be maintained uniformly because the grindstone was simply press-molded after alternating polishing powder layers and glass fibers. The oblique glass fibers (which display a wave shape in the grindstone) lower grinding efficiency, so deviation is produced in the abrasion of the rotation grindstone, and the so-called unsymmetrical wear phenomenon results. One of the causes of the unsymmetrical wear phenomenon is believed to be the fact that compressic unevenness results from the compression of thick grindstone materials.

The high-speed rotating grindstone of this invention is as follows: Thin unit grindstones containing glass fiber mesh cloths are formed. Therefore, in contrast to the aforementioned conventional product composed of a single piece, the mesh cloth does not form a wave shape, and only a little inserted glass fiber is required. Moreover, almost no difference occurs in the pressurization force inside and outside the grindstone when it is pressurized with a press because the unit grindstones formed in this way are thin. The degree of bonding, porosity and density are uniform. Therefore, the grindstone can withstand high-speed rotation. In ordder to make a high-speed rotating grindstone using this kind of unit grindstone, it is advisable to use a process in which a fixed thickness is created by laminating successively the uncalcined unit grindstones (2) around the axial pipe (4) as shown in FIG. 4, after which it is calcined and unified. The spaces between the unit grindstones are left as such or phenolic resin is repeatedly applied. Following calcination, the lines of the lamination gaps almost completely disappear due to the mutual meltadhesion of the unit grindstones. Also, comparatively large separated pores are formed in the gap portions, and these reduce the bulk specific gravity of the entire grindstone. Moreover, the molded unit grindstones are close together, and the strength increases. A good grindstone results that as a whole, does not shrink due to calcination and that has a low degree of bonding. Even though the resin content is increased to 26–27%, an amount unimaginable in conventional grindstones, the aforementioned pore formation is helpful, and a grindstone having an extremely good grinding efficiency results. For example, in contrast to the aforementioned commercial high-speed rotating grindstone that has a bulk specific gravity of 2.32 and a degree of bonding of 0.35, the grindstone of this invention is a hard product with a small degree of bonding (0.24) despite the fact that its bulk specific gravity is also small (2.15).

Most of the presently marketed resinoid grindstones for ordinary grinding have a bulk specific gravity of 2.25–2.55 and a degree of bonding above 0.25. The resin content inferred from this degree of bonding is on the order of about 15–17%. This is common knowledge in the industry. In conventional production processes grindstones are produced with a reduced resin content in order to reduce the bulk specific gravity. However, the strength is decreased and the degree of bonding is large. In this case, the holding power of the grinding granule is weak in grinding very hard materials such as iron. Much of the grinding granule falls off, and as a result the grindstone does not withstand use. On the other hand, when the resin content is increased in order to raise the strength, the porosity decreases, i.e., the bulk specific gravity increases, and the grinding efficiency is markedly lowered. Also, in a process where the resin content is raised and the molding pressure is lowered, calcination shrinkage occurs during calcination, and the region between the axis and outer circumference of the grindstone collapses. A grindstone is produced with an imbalance between the bulk specific gravity and degree of bonding. Such a grindstone has inferior efficiency and marketability.

The grindstone of this invention is a strong grindstone with a high porosity not found in conventional grindstones. Table 1 gives an example of the properties and grinding efficiency of the grindstone of this invention and compares these to values for a conventional grindstone.

TABLE 1

| | | Product of this Invention | Conventional Product |
|---|---|---|---|
| Bulk Specific Gravity | | 1.9–2.2 (1.95–2.15) | 2.25–2.55 (2.3–2.5) |
| Degree of Bonding | | 0.25 or below (0.2–0.05) | 1.58–0.23 (0.5–0.3) |
| Resin Content (%) | | 20–26 (21–25) | 13–18 (estimate) (16–18) |
| ALUMINUM | Grinding Ratio*1 | 25–35 | 13–18 |
| | Grinding Efficiency*2 | 250–300 | 200–300 |
| | Overall Efficiency*3 | 6–9 | 2.5–5 |
| STAINLESS STEEL | Grinding Ratio*1 | 5–10 | 4–10 |
| | Grinding Efficiency*2 | 700–1200 | 400–700 |
| | Overall Efficiency*3 | 5–8 | 2–5 |

Note:
The numbers inside the parentheses indicate the desired value or maximum region.
*1Grinding ratio: Ground amount (g)/Grindstone wear (g)
*2Grinding efficiency: Amount grinding (g) per hour
*3Overall efficiency: Grinding ratio × grinding efficiency/1000

As is clear from the results in Table 1, high efficiency and properties unimaginable in conventional grindstones for ordinary grinding were obtained. That is the bulk specific gravity was 1.9–2.2, and the degree of bonding was 0.25 or below. The degree of bonding (where symbols are used for values (below 0.23) not found in the JIS standards (JIS R6212) was below R. In order to bring about this degree of bonding, the resin (e.g., phenolic resin) content must be increased to more than 20%. As a result, the bulk specific gravity of the obtained grindstone becomes remarkably large, a decreased grinding efficiency results from a drop in the porosity, and a grindstone that cannot be put to practical use results. For the following reasons the usefulness of porosity and grinding efficiency has been recognized hereto: (a) the relationship between porosity and grinding efficiency has not been insufficiently clear; (b) rather, it was believed that an undesirable increase in grindstone wear results when the porosity is increased excessively; and (c) grindstones having properties such as those of this invention had not been obtained.

The production process of this invention resolved this problem. In this production process, the thickness of individual grindstones was set at 2–10 mm, and a fixed number of layers of grindstones (formed individually by increasing the amount of resin and using a molding pressure identical to or slightly lower than, the conventional molding pressure) were laminated. After uniting these by simply superimposing them or by pressure-welding them using a pressure lower than the molding pressure, the unit grindstones were united by calcination. For example, in order to obtain a 20 mm-thick rotating grindstone, thin grindstones were formed individually so that their thickness after calcination was 4 mm. Five of these uncalcined grindstones were superposed, and the grindstone was produced by calcinating and uniting the composition of grindstones that was united by preliminary molding. During calcination, the laminated portion was sintered and united. Moreover, because the individual thin layer grindstones caused slight calcination shrinkage, calcination was uniform to the interior. Moreover, discrete gaps were formed in the superposed portion. These increased the porosity of the entire grindstone, and the bulk specific gravity was decreased and the strength was increased.

The gaps obtained in the laminated portion of the thin layer grindstone differed entirely from those in the laminated gap grindstone in which individual thin layer grindstones were calcined and united. As a result, these summed to contribute to an improvement in the grinding efficiency, in addition to the aforementioned air cooling effect of the gaps. Moreover, even in the stationary grinding called plunge cut, the gaps were very useful in that they enabled grinding that no longer produced residual grinding stripes and yielded a flat finished surface.

When the calcined grindstone is impregnated as required with a waxy substance (e.g., paraffin wax), a higher fatty acid, or a higher alcohol, a grindstone results that has a more superior grinding capacity.

Also the aforementioned amount of resin and optimal value of the bulk specific gravity differ somewhat according to the kind of material to be ground. For example, it was determined that a grindstone with apparent specific gravity of 2.04 and a resin content of about 21% was good for aluminum, and one with an apparent specific gravity of 2.15 and a resin content of about 23–24% was good for stainless steel.

Below, this invention will be explained in greater detail using embodiments.

EMBODIMENT 1

Using alumina A polishing powder #24 as the polishing powder, and using a thermosetting phenolic resin ordinarily used as a resin, the polishing powder and resin were mixed and caked, and thin layer grindstones were made by compression-molding this semi-dried mixture using a cold-pressure method. After a fixed number of layers were laminated, they were compressed and united using about 5 kg/cm$^2$. This was placed into an electric furnace, and calcined for 30 hours at 180° C., forming the finished product. In the embodiments the resin content was varied from 20–26%. Both a grindstone consisting of a single molded layer and having a 71% resin content as well as a commercial product were supplied as comparative examples. Furthermore, the grindstone size was 100 mm (o.d.)×20 mm (thickness)×20 mm (hole diameter).

Grinding conditions were as follows: Using a high-speed grinder made by the Fuji Air Corporation, an approximately 5 kg load was applied using hand processing at a rotational frequency of 12,000 rpm and revolution speed of 3500 m/mm. Grinding was performed in 10 successive 1 minute periods, and the amount of ground (g) and grindstone wear (g) were sought. The test piece was 10 mm wide, and stainless steel (SUS 304) was used.

Test results are shown in Table 2 on the following page.

Regarding the fact that a product of sufficient porosity could be produced despite a composition with a resin content greatly exceeding conventional values, the production process of this invention was simple and unconventional. Moreover, its usefulness can be demonstrated using the superior grinding efficiency of the obtained product. Also, the degree of bonding is a low numerical value and indicates high strength, so an ultra-high speed rotating grindstone is obtained when glass wool is inserted during molding. Also, the grindstone of this invention and its production process merit attention in view of the fact that it is a high-quality grindstone that can be used also as a highly efficient grindstone for heavy grinding.

EMBODIMENT 2

The grindstone shown in Table 3 was prepared according to the production in Embodiment 1. Using this grindstone grinding tests were performed for carbon steel. The results are shown in Table 4.

TABLE 3

| | EMBODIMENT | COMPARATIVE EXAMPLE (commercial product) |
|---|---|---|
| Polishing Powder | A 24 | A 24 |
| Grindstone Size | 100 × 20 × 19.05mm 5 layers (about 4mm thick, including 1 sheet glass fiber) | 100 × 20 × 20 1 layer (including 5 sheets glass fiber) |
| Bulk Specific Gravity*1 | 2.15 | 2.32 |
| Degree of Bonding*2 | 0.24 | 0.35 |

*1According to mensuration of JIS R6240.
*2According to the JIS R6240 Ogoe test method.

TABLE 4

| GROUND MATERIAL GRINDING CONDITION | S45C CARBON STEEL FOR MECHANICAL STRUCTURE Load 3kg, revolution speed 3650/min (12500 rpm) | | | |
|---|---|---|---|---|
| Grindstone Kind | Embodiments | | Comparative Examples | |
| 1 Minute Grind Test Number | Grindstone Wear (g) | Amount Ground (g) | Grindstone Wear (g) | Amount Ground (g) |
| 1 | (343.0) | 5.4 | (359.0) | 2.5 |
| 2 | | 4.6 | | 1.0 |
| 3 | | 5.1 | | 1.0 |
| 4 | | 3.6 | | 3.0 |
| 5 | | 3.4 | | 2.0 |
| 6 | | 2.5 | | 0.1 |
| 7 | | 3.1 | | 0.1 |
| 8 | | 1.6 | | 0.5 |
| 9 | | 1.6 | | 0.1 |
| 10 | (337.0) | 1.2 | (356.5) | 1.0 |
| Total (g) | 6.0 | 32.1 | 2.5 | 11.3 |
| Average (g/min) | 0.60 | 3.21 | 0.25 | 1.13 |
| Grinding Ratio*1 (g/g) | 5.35 | | 4.52 | |
| Grinding Efficiency*2 (g/hr) | 192.6 | | 67.8 | |
| Overall Efficiency*3 | 1.03 | | 0.31 | |
| Comparative Efficiency | 1 | | 0.3 | |

*1(same as m in Table 1)
*2(same as n in Table 1)
*3(same as o in Table 1)

As is clear from the results in Table 4, the high-speed rotating grindstone of this invention ground about 3 times as much as the best conventional commercial product, and it has a superior grind ratio (which allows for grindstone wear). The overall efficiency was 1:0.3, a 3-fold improvement.

TABLE 2

| | EMBODIMENTS | | | | | COMPARATIVE EXAMPLES | | |
|---|---|---|---|---|---|---|---|---|
| | 1 | 2 | 3 | 4 | 5 | 1 | 2 | |
| Molding Process | 4mm 5 layer lamination | 4mm 5 layer lamination | 4mm 5 layer lamination | 4mm 5 layer lamination | 4mm 5 layer lamination | 20mm 1 layer molding (Commercial Product A24P) | | |
| Resin Content (%) | 20 | 21 | 22 | 24 | 26 | 17 | 17 | (estimate) |
| Bulk Specific Gravity | 2.01 | 2.12 | 2.14 | 2.15 | 2.19 | 2.55 | 2.32 | |
| Degree of Bonding | 0.24 | 0.20 | 0.15 | 0.17 | 0.08 | 0.37 | 0.35 | |
| Ground Amount (g/10min) | 158 | 140.8 | 153.0 | 144.7 | 115.5 | 108.8 | 81.0 | |
| Amount of Wear (g/10min) | 26.5 | 19.8 | 22.5 | 16.7 | 14.0 | 27.2 | 9.4 | |
| Grinding Ratio | 5.95 | 7.11 | 6.8 | 8.66 | 8.25 | 4.0 | 8.62 | |
| Grinding Efficiency | 950 | 845 | 918 | 868 | 693 | 653 | 486 | |
| Overall Efficiency | 5.65 | 6.01 | 6.25 | 7.52 | 5.71 | 2.61 | 4.19 | |
| Comparative Efficiency (vs. commercial product) | 1.32 | 1.43 | 1.49 | 1.79 | 1.36 | 0.62 | 1 | |

As a result of rotary destruction tests, it was found that this grindstone displayed superior strength and was not destroyed even at 35,000 rpm. A higher rate of rotation exceeded the capacity of the test device but is anticipated.

The reasons the grinding efficiency is so remarkably improved and a highly strong grindstone results are believed to be as follows: (a) adequate compaction-molding is possible using thin unit grindstones; (b) glass fibers are almost evenly inserted into these unit grindstones, so overall uniform strengthening is possible; and (c) during calcination the laminated gaps unite forming comparatively large air pores, so the overall bulk specific gravity is lowered. As a result, a high-speed rotational grindstone with an unconventional structure is formed.

I claim:

1. A process for producing a high-speed resinoid thick disk rotating grindstone comprising the steps of:

(a) forming a plurality of thin uncalcinated unit grindstones of 2 to 10 mm in thickness by pressmolding a mixture of polishing powder and thermosetting resin into which has been inserted a sheet of glass fiber mesh cloth oriented parallel to the lateral surfaces of the finished unit grindstone, the relative quantity of said polishing powder and said thermosetting resin being selected so as to result in a unit grindstone having a resin content of from 20% to 26%;

(b) laminating said plurality of unit grindstones to a desired thickness of the finished thick grindstone, the individual unit grindstones being arrayed along an axial pipes; and (c) calcinating the laminated array of unit grindstones formed in step (b) into a single unitary thick disk grindstone by heating said laminated unit grindstones to a temperature of between 180° to 200° C. for a preset period of time.

2. A process of producing a high-speed resinoid thick disk grindstone according to claim 1, wherein said resin is phenolic resin.

* * * * *